US008272844B2

(12) United States Patent
Sugioka

(10) Patent No.: US 8,272,844 B2
(45) Date of Patent: Sep. 25, 2012

(54) LIQUID DRIVER SYSTEM USING A CONDUCTOR AND ELECTRODE ARRANGEMENT TO PRODUCE AN ELECTROOSMOSIS FLOW

(75) Inventor: Hideyuki Sugioka, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 349 days.

(21) Appl. No.: 12/605,415

(22) Filed: Oct. 26, 2009

(65) Prior Publication Data

US 2010/0294652 A1 Nov. 25, 2010

(30) Foreign Application Priority Data

May 25, 2009 (JP) ..... 2009-125787

(51) Int. Cl.
*G01N 27/00* (2006.01)

(52) U.S. Cl. ..... 417/50; 204/450; 204/600

(58) Field of Classification Search ..... 417/48, 417/49, 50, 51; 204/450, 451, 600, 601
See application file for complete search history.

(56) References Cited

U.S. PATENT DOCUMENTS 6,942,018 B2 * 9/2005 Goodson et al. ..... 165/80.4
7,081,189 B2 * 7/2006 Squires et al. ..... 204/451
7,302,970 B2 12/2007 Sugioka et al.
7,691,244 B2 * 4/2010 Levitan et al. ..... 204/450
7,708,872 B2 * 5/2010 Eidsnes et al. ..... 204/451
2003/0164296 A1 * 9/2003 Squires et al. ..... 204/450
2005/0230251 A1 * 10/2005 Eidsnes et al. ..... 204/450
2007/0240989 A1 * 10/2007 Levitan et al. ..... 204/451
2011/0052431 A1 * 3/2011 Heldal et al. ..... 417/410.1

OTHER PUBLICATIONS

M. Z. Bazant, "Induced-Charge Electrokinetic Phenomena: Theory and Microfluidic Applications", Physical Review Letters, vol. 92, No. 6, pp. 066101-1 to 066101-4 (Feb. 13, 2004).

* cited by examiner

*Primary Examiner* — Devon Kramer
*Assistant Examiner* — Nathan Zollinger
(74) *Attorney, Agent, or Firm* — Fitzpatrick, Cella, Harper & Scinto

(57) ABSTRACT

A liquid driver system having a flow channel for delivering a liquid, includes a conductor member placed in the flow channel, electrodes for applying an electric field to the conductor member and delivering the liquid by application of a driving force to the liquid by electroosmotic flow produced around the conductor member by the electric field, and a first flow limiter at a position displaced from the conductor member to limit a liquid flow in a reverse direction of liquid flowing in forward and reverse directions relative to the conductor member, wherein a maximum length of the flow limiter is smaller than a length of the conductor member in the forward flow direction, and the flow limiter is placed relative to the conductor member, having a thickness (2*c*), such that a gap (δ) between the conductor member and the flow limiter satisfies the relation of δ<c.

17 Claims, 7 Drawing Sheets

LIQUID DRIVER SYSTEM USING A CONDUCTOR AND ELECTRODE ARRANGEMENT TO PRODUCE AN ELECTROOSMOSIS FLOW

BACKGROUND OF THE INVENTION

1. Field of the Invention

The present invention relates to a liquid driver system, specifically to a liquid driver system utilizing induced-charge electroosmosis applicable as a pumping system or the like.

2. Description of the Related Art

Micro-pumps utilizing electroosmosis are used in application fields such as a μTAS (micro-total analysis system) since the micro-pump has a relatively simple structure containing no moving member and can be installed in a minute flow channel.

Recently, the micro-pumps utilizing induced-charge electroosmosis are attracting attention because the pumps are capable of driving a liquid at a high flow rate and preventing a chemical reaction between the electrode and the liquid by AC driving.

U.S. Pat. No. 7,081,189, and M. Z. Bazant and T. M. Squires: Phys. Rev. Lett. 92, 066101 (2004) disclose pumps utilizing the induced-charge electroosmosis (ICEO).

The pumps disclosed include: (1) a half-coat type ICEO pumps which control the liquid flow by adjusting the region of charge induction in a metal post by an electric field by coating a half of the metal post between the electrodes with a dielectric thin film; and (2) an asymmetric metal post type ICEO pump which controls a flow of the liquid in a fixed direction by placing a metal post having a triangular or other asymmetric shape between the electrodes.

The half-coat type ICEO pump (1) disclosed in the above U.S. Patent and the reference document (Phys. Rev. Lett.) needs formation of a dielectric film for masking partially the metal post, which increases the number of steps of the production process, and increases the number of the mask sheets. Therefore, another approach is necessary for production of the system having a higher performance at a lower cost.

The asymmetric post type ICEO pump (2) controls the liquid flow in a certain direction as a whole by improving the shape of the metal post. However, the simple improvement only of the shape of the post tends to cause inevitably a liquid flow in a reverse direction in addition to the normal forward direction. Therefore, by limiting the reverse flow, the flow rate of the liquid discharged from the pump can be increased more.

SUMMARY OF THE INVENTION

The present invention has been achieved to improve the above described background techniques, and provides a liquid driver system which is capable of limiting the reverse flow of the liquid caused inevitably against the intended normal forward flow regardless of the shape of the conductor member The present invention is directed to a liquid driver system having a flow channel for delivering a liquid, a conductor member placed in the flow channel, and electrodes for applying an electric field to the conductor member; and delivering the liquid by application of a driving force to the liquid by electroosmotic flow produced around the conductor member by the electric field; the liquid driver system having a flow limiter near the conductor member to limit a liquid flow in a reverse direction of liquid flows in normal and reverse directions relative to the conductor member.

The conductor member and the flow limiter can be placed with the gravity centers thereof displaced from each other.

The width w of the flow channel, the size of the gap δ between the conductor member and the flow limiter, and the thickness 2*c* of the conductor member can satisfy the relation below:

$$(\delta/w)(c/w)<0.03$$

The flow limiter can be smaller in size than the conductor member.

The length of the flow limiter can be smaller than the length of the conductor member in the normal flow direction.

The flow limiters in a pair can be placed on both sides of the conductor member.

The front tip portion of the conductor member facing to the liquid flow in the normal flow direction can be curved or in an acute angle shape.

In the liquid driver system, another flow limiter smaller than the flow limiter can be placed additionally near the flow limiter.

The present invention provides a liquid driver system which limits a reverse flow of the liquid, caused inevitably regardless of the shape of the conductor member, against the normal forward flow. This enables the liquid delivery at a higher flow rate in the forward direction.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
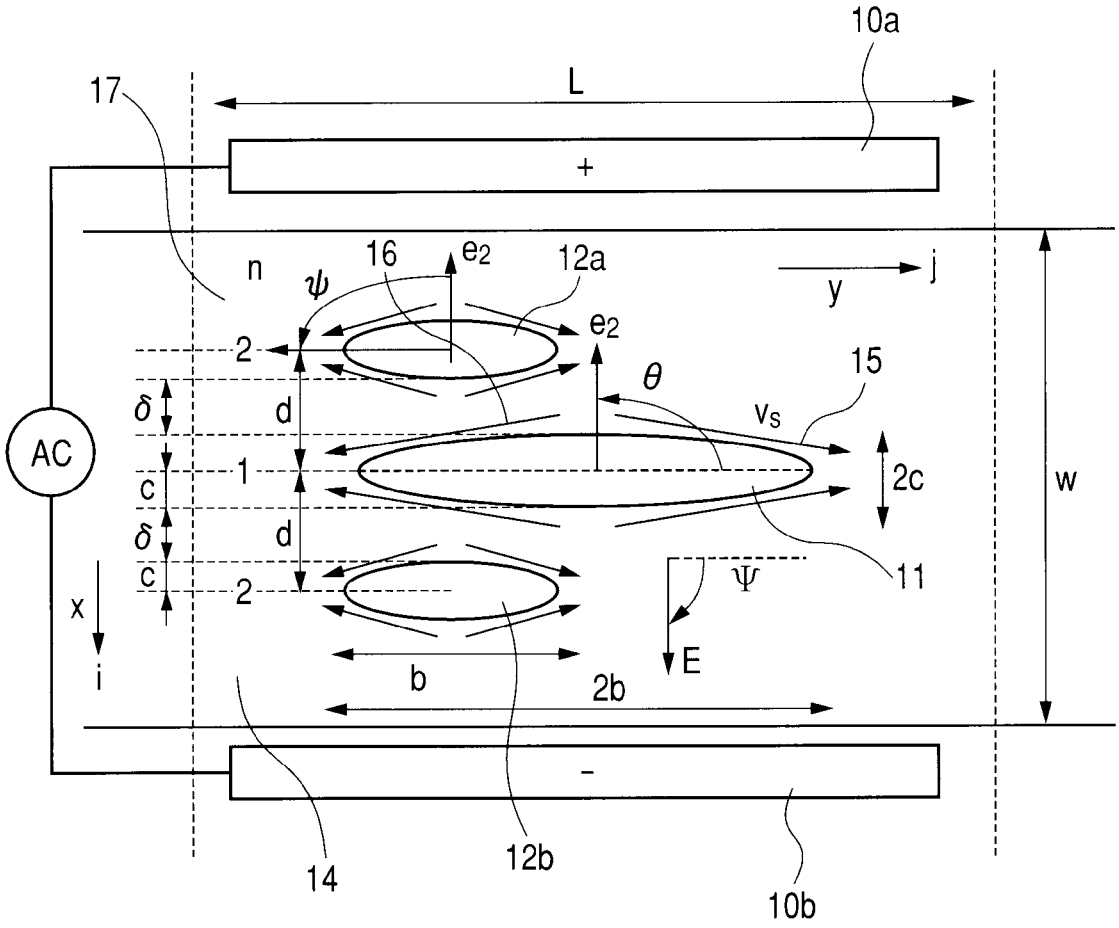
FIG. 1 illustrates a constitution of the liquid driver system of the present invention.

FIG. 1 illustrates a constitution of the liquid driver system of the present invention. In FIG. 1, the liquid driver system of the present invention comprises flow channel 14 for delivering liquid 17; conductor member 11 provided in flow channel 14; and electrodes 10*a*, 10*b* for applying an electric field to conductor member 11; and delivers the liquid by applying a driving force by electroosmosis stream generated by the electric field around conductor member 11.

In the system illustrated in FIG. 1, a voltage is applied between electrodes 10*a*, 10*b* to generate an electric field. The electric field induces an electric charge on the surface of conductor member 11. The induced electric charge attracts charged components (cations, anions, etc.) in liquid 17 to form an electric double layer to cause movement of the charged components around the electric double layer to cause a flow of the liquid. In this liquid driver system, the electric charges induced in conductor member 11 apply a driving force to the liquid to cause the flow of the liquid by the induced-charge electroosmosis.

In FIG. 1, the liquid flow includes normal forward flow 15 (flow in the first direction) and reverse flow 16 (flow in directions other than the normal flow direction) around conductor member 11. Flow limiters 12*a*, 12*b* for limiting the reverse flow 16 are placed in the vicinity to conductive member 11 but are displaced from conductor member 11.

Flow limiter 12*a* (12*b*) is placed at a position displaced from conductor member 11 to limit reverse flow 16 of the liquid. The flow limiter can limit the reverse flow (flow in the second direction) which is caused inevitably regardless of the shape of the conductor member, and enables delivery of the liquid at a higher flow rate in the normal flow direction.

The limitation of the reverse flow by flow limiter 12*a* (12*b*) results from a small gap in the flow channel between conductor member 11 and flow limiter 12*a* (12*b*).

The position displaced from the conductor member signifies the position of the gravity center of the flow limiter shifted from the gravity center of the conductor member in the direction of the liquid flow.

In order to limit effectively the reverse flow (flow in the second direction relatively to the conductor member), the flow limiter is preferably smaller in size than the conductor member. The flow limiter is preferably shorter in the normal flow direction (the first direction) than the conductor member. The length of the flow limiter is preferably about ½ the length of the conductor member.

The number of the conductor members is not limited to one in one flow channel 14, but may be two or more, and flow limiters may be installed in numbers corresponding to the number of the conductor members.

In the system illustrated in FIG. 1, flow limiters 12*a*, 12*b* in a pair are placed on both sides of the one conductor member 11, but the number and arrangement of the flow limiter is not limited thereto. One flow limiter is installed for plural conductor members, or three or more flow limiters may be installed for one conductor member.

The conductor member may be made of a material which can induce an electric charge on application of an electric field, including metals (e.g., gold and platinum), and carbon and carbon type material. The material is preferably stable to the liquid to be driven.

The material comprising the flow limiter may be selected from the group consisting of a conductive material such as semiconductor and dielectrics as well as gold, platinum, carbon, carbon type material and so forth. The material is also preferably stable to the liquid to be driven.

The front tip face of the conductor member in confronting the liquid flow in the normal forward direction has a curved face or an acute angle shape.

In the vicinity to the above flow limiter, another smaller flow limiter may be placed.

In FIG. 1, a pair of electrodes 10*a*, 10*b* are placed in opposition for applying an electric field to conductor member 11, but three or four electrodes may be provided insofar as the charges can be induced effectively in conductor member 11. The material for the electrode includes usual electrode materials such as metals, and includes also gold, platinum, and carbon type conductive materials. In FIG. 1, an electric field of AC (alternate current) is applied for the driving, but instead an electric field of DC (direct current) may be applied.

Flow channel 14 may be constructed from a material usually used in the field of μTAS and the like, the material including $SiO_2$, Si, fluororesins, polymer resins in the present invention.

The liquid which can be delivered through flow channel 14, in the present invention, is basically a liquid containing a polar substance having a chargeable component, including water and solutions containing an electrolyte. However, a liquid containing no chargeable component can be delivered by employing, as a carrier, another liquid containing a chargeable component.

The present invention is described below in detail with reference to specific examples without limiting the invention in any way.

Example 1

This Example is described with reference to FIG. 1. FIG. 1 is a sectional view of a liquid driver system of the present invention. The system shown in FIG. 1 produces the effect of pumping by placing a conductor member and flow limiters close together.

In FIG. 1, the reference numerals denotes the following members: 10*a* and 10*b*, a pair of electrodes; 11, a conductor member (the first-generation electrode post which causes the normal forward flow and the reverse flow when another structure is absent in the vicinity); 12*a* and 12*b*, flow limiters (the second-generation electrode post for limiting the reverse flow caused by the first-generation post). Here, conductor member 11 and flow limiters 12*a*, 12*b* can be understood as a hierarchical stacking structure, in which a reverse flow produced by a conductive structure of a k-th generation is limited by a flow limiter of a (k+1)-th generation.

Flow channel 14 is in a shape of a rectangular solid having a width w of 100 μm, a length of 225 μm, and a depth D (>w), and is filled with a polarizable solution like water or an aqueous electrolyte solution. The numerals 15 and 16 denote liquid flows produced around conductor member 11 by an induced-charge electroosmosis on application of an electric field: the numeral 15 denotes a flow in a normal forward direction, and the numeral 16 denotes a flow in a reverse direction. The system of this Example is a micro-pump utilizing induced-charge electroosmosis (ICEO). In this system, flow limiters 12*a*, 12*b* are placed close to conductor member 11 to limit the reverse flow 16.

The conductor member is constructed from an electrochemically inert substance such as platinum, gold, carbon, and carbon type electro-conductive compounds. The flow limiter is constructed from an insulating material or a conductive substance. For formation of the hierarchical structure, the same material as of the conductor member is preferably used for the flow limiter such as platinum, gold, carbon, and carbon type for conductor member for the convenience in the production process.

Flow limiters (second metal posts) 12*a*, 12*b* having nearly the same length as the reverse-flow-producing region are placed close to the positions where reverse flows 16 are produced around the conductor member (first metal post) 11.

In the system illustrated in FIG. 1, the symbols denote the followings: w, the width of the flow channel; δ, the gap between conductor member 11 and the flow limiter; 2*c*, the thickness of conductor member 11. In this system, the flow limiter is placed near to conductor member 11 preferably to satisfy the relation of δ<c in view of effective limitation of the reverse flow. More preferably the flow limiter is placed near so as to satisfy the relation: (δ/w)(c/w)<0.03. The symbol c herein represents a half of the thickness of the conductor member. The thickness is measured by sandwiching the conductor member with imaginary infinite parallel plates. When the conductor member is an elliptical post, 2*c* represents the length of the minor axis of the ellipsoid.

In this Example, the symbol 2*c* denotes the minor axis length (short diameter) of the elliptical conductor member; 2*b* denotes the major axis length (long diameter) thereof; d denotes the distance between the gravity center of the elliptical conductor member and the gravity center of the elliptical flow limiter; and the gap δ denotes the maximum distance between two imaginary parallel plates which can be placed to be in contact with conductor member 11 and flow limiter 12*a* (12*b*). In the layered structure constituted of the conductive elliptical columns illustrated in FIG. 1, the gap δ is defined by the interspace between elliptical conductor member 11 and elliptical flow limiter 12*a* (12*b*): δ=d−2c.

In FIG. 1, the symbols denote the followings: E, an electric field; y, a unit vector in the y-direction; j, a unit vector in the x-direction; n, a generation number of the elliptical structure having a hierarchical structure; x, the x-axis perpendicular to the electrode face; y, the y-axis parallel to the electrode face; the numeral 1, the generation number indicating the first-generation elliptical structure; the numeral 2, the generation number indicating the second-generation elliptical structure; θ (=90°), an inclination angle of the elliptical structure relative to the y-axis; ψ (=90°), an inclination angle of the electric field vector relative to the y-axis; $e_2$, a unit direction vector in the short axis direction of the elliptical structure; Vs, a slip velocity caused by the electroosmotic flow produced by electric field application along the elliptical structure outside the electric double layer; and ϕ, a parameter for specifying the position on the elliptical surface.

The characteristic features of the liquid driver system of the present invention are described below. FIGS. 2A to 2D are drawings for describing flows of the liquid driven by the liquid driver system of the present invention, showing distributions of the flow rate vectors in the flow channel.

The flow rate herein is calculated in consideration of induced-charge electroosmosis effect according to Equation 1 below based on the Stokes' equation, assuming 2w=100 μm, b/w=0.4, c/w=0.025, and the applied voltage $V_0$=2.38 V.

$$\mu\nabla^2 v - \nabla p = 0,\ \nabla\cdot v = 0,\ (\text{on metal: } v = v_s,)$$

$$v = \frac{1}{2}U_b(\beta+1)^2 q_b^{-1}\sin 2(\Psi+\varphi+\theta)t,$$

wherein the characteristic flow rate is represented by Equation 2:

$$q_b=\sqrt{\cos^2\phi+\beta^2\sin^2\phi},\ U_b(=\in bE_0^2/\mu)$$

in which β=c/b.

The position of the elliptical structure represented by ϕ is represented by Equation 3:

$$x(=-b\sin\phi e_1+c\cos\phi e_2)$$

The unit tangent vector is represented by Equation 4:

$$t=-q_b^{-1}(\cos\phi e_1+\beta\sin\phi e_2)$$

where $$e_1=\sin\theta j+\cos\theta i,\ e_2=\cos\theta j-\sin\theta i$$

In the above Equations, the symbols denote the followings: μ, the viscosity (≈1 mPa·s); v, the flow rate vector; $v_s$, the sliding rate vector; p, the pressure; ∈ (≈80$\in_0$), the dielectric constant of the solution (typically water); and $\in_0$, the dielectric constant of the vacuum.

FIGS. 2A to 2D are drawings for describing the flow of the liquid driven by a liquid driver system of Example 1.

Figure 2A:
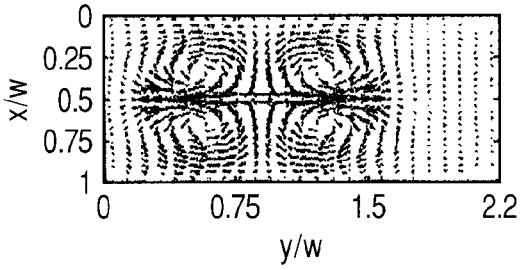
FIGS. 2A, 2B, 2C, and 2D are drawings for describing flow of the liquid driven by the liquid driver system of the present invention.

FIG. 2A shows distribution of the flow rate vectors in the case where conductor member 11 only is employed without a flow limiter. FIG. 2A shows that an isolated conductor member 11 cannot produce a net liquid flow in the normal direction because the isolated conductor member causes also the reverse flow at a flow rate equal to the rate of the normal flow, not functioning as the pump.

Figure 2B:
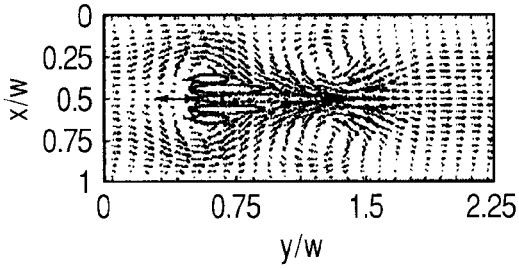
Figure 2C:
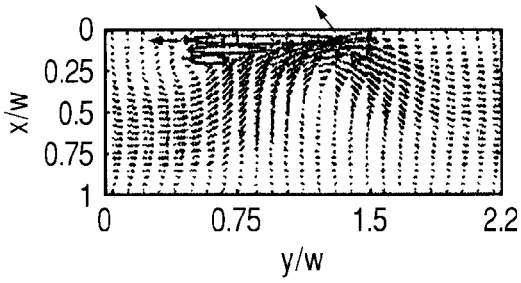
Figure 2D:
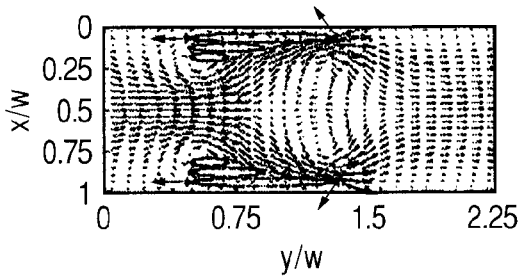

FIGS. 2B to 2D show distributions of the flow vectors in the cases where flow limiters are placed in the regions of reverse flow production.

FIG. 2B shows the vector distribution when two flow limiters having different lengths are placed on the respective sides of the conductor member. FIG. 2C shows the vector distribution when two flow limiters having different lengths are placed on one side of the conductor member. FIG. 2D shows the vector distribution when two conductor members are employed and a set of flow limiters having different lengths is respectively placed in opposition to each of the two conductor members.

As shown in FIGS. 2B to 2D, the flow limiters limit the reverse flow effectively to generate the net normal flow rightward in the drawings, producing an effective pumping action.

The liquid flow rates, Up, representing the performance of the pump (an average flow rate measured at the inlet of flow channel 14) in FIGS. 2A to 2D are respectively Up=0 (FIG. 2A), 1.31 (FIG. 2B), 0.97 (FIG. 2C), and 1.51 (FIG. 2D) mm/s. The flow rates in FIGS. 2B to 2D are higher by about one-order than conventional linear type electroosmosis pumps.

Figure 3:
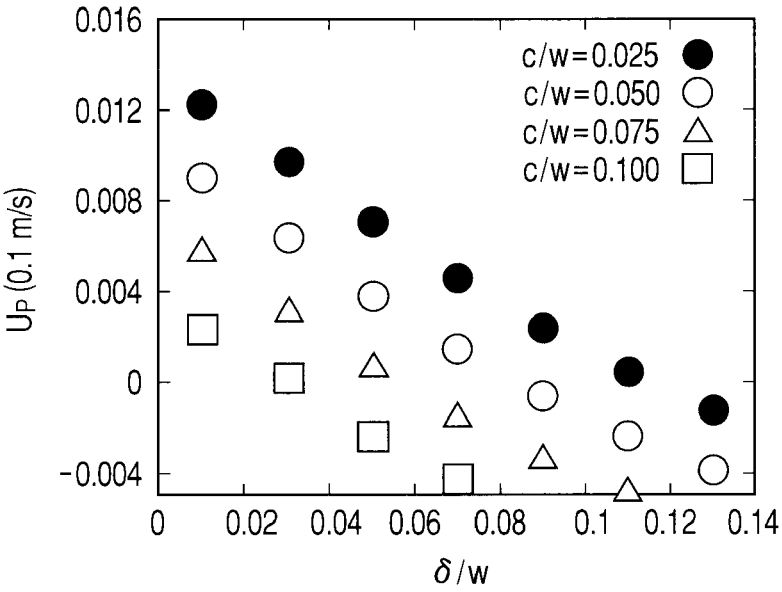
FIG. 3 is a graph showing dependences of the average flow rate Up of the liquid driven by the liquid driver system of the present invention on the flow channel width w.

FIG. 3 is a graph showing the dependency of the average flow rate Up on δ/w and c/w in the systems illustrated in FIG. 2B. The average flow rate Up is calculated according to Stokes' equation in consideration of the induced-charge electroosmosis in the same manner as the flow rates in FIGS. 2A to 2D. In the calculation, w=100 μm, b/w=0.4, and the applied voltage is 2.38 V.

As shown in FIG. 3, a net normal forward flow can be obtained at δ/w<ca 0.03 at c/w=0.1; at δ/w<ca 0.07 at c/w=0.05; and at δ/w<ca 0.1 at c/w=0.025. Thus the pumping action can be obtained when the relation of (δ/w)(c/w)<0.03 is satisfied.

In a preferred constitution, a conductor member having a length of 2*b* (=0.8w) is provided as a first-generation metal post, and on each of the both sides at the reverse flow generating regions, a flow limiter (second-generation metal post) having a half length (=b) relative to the reverse flow-producing region is placed near and parallel to the conductor member, and this constitution is repeated hierarchically to an N-th generation.

In the hierarchical structure, the average flow rate with the hierarchical stacking pump is represented by Equation 6 below.

$$U_p = U_p^{forward} - U_p^{reverse}$$

where $$U_p^{forward} = \frac{4}{3}\left(1 - \left(\frac{1}{4}\right)^{N-1}\right)\eta_n \eta_k^{\sigma_K} \eta_{k_1} \eta_0 v_s^{max},$$

$$U_p^{reverse} = 0.4\eta_n v_s^{max} \frac{\delta}{w}$$

Therefore, the present invention is effective under the condition:

$$U_p^{forward} > U_p^{reverse}$$

Thus, a hierarchical stacking structure is effective under the condition of Equation 9 below:

$$\frac{4}{3}\left(1 - \left(\frac{1}{4}\right)^{N-1}\right)\eta_n \eta_k^{\sigma_K} \eta_{k_1} \eta_0 v_s^{max} > 0.4\eta_n v_s^{max} \frac{\delta}{w}$$

In the above Equations, N denotes the number of the last generation, $V_s^{max}$ denotes the maximum sliding velocity on the conductive elliptical cylinder, $\eta_0$ is a substantive efficiency of a half-coat pump, and $\eta_k$ is a factor for the effect of the narrowing of the flow channel shown by the Equation 10 below:

$$\eta_k = (w-K)/w \text{ and } \eta_{k_1} = (w-K_1)/w$$

wherein K and $K_1$ denote the width of the obstacle for limiting the flow of the liquid. For the pump of type A, type B, and type C, K is respectively $K=2c(2N-1)+2\delta(N-1)$, $2cN+\delta(N-1)$, and $4cN+2\delta(N-1)$; and respectively $K_1=2c$, $2+\delta$, and $4c+2\delta$; $\delta_k$ is respectively $\delta_k=1.9$, 0.7, and 0.7; and $\eta_n$ is respectively 1, 0.5, and 1. The average flow rate of the half-coat pump is represented by Equation 11 below:

$$U_{p0} = \eta_{k_1}^{0.7} \eta_0 v_s^{max},$$

From this Equation, $\eta_n=0.12$. In the above Equations, $$v_s^{max} = U_b(\beta+1)^2 \sin\varphi_0 / \sqrt{1+\beta}$$

$$\left(\varphi_0 = \tan^{-1}\sqrt{1/\beta}, \text{ maximum at } \psi = \theta = \pi/2\right)$$

Here, the type-A pump is a pump as shown in FIG. 2B in which on both sides of the conductive structure of the first generation, conductive structure of the second generation and succeeding conductive structures are hierarchically stacked. The type-B pump is a pump as shown in FIG. 2C in which the flow channel wall is close to one side of the first-generation conductive structure and the second- and later-generation conductive structures are stacked thereon. The type-C pump is a stacking-type pump as shown in FIG. 2D in which the type-B pumps are placed on both sides of the flow channel.

Figure 9A:
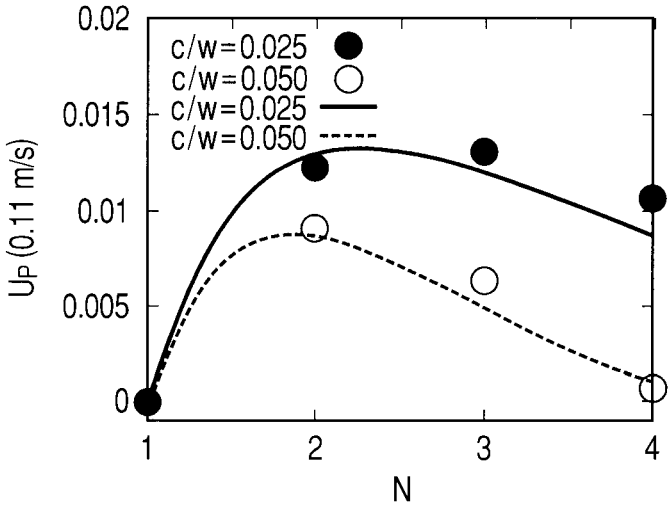
FIGS. 9A and 9B are graphs showing dependences of the average flow rate of a liquid driven by the liquid driver system of the present invention on the generation number N of the conductive member.
Figure 9B:
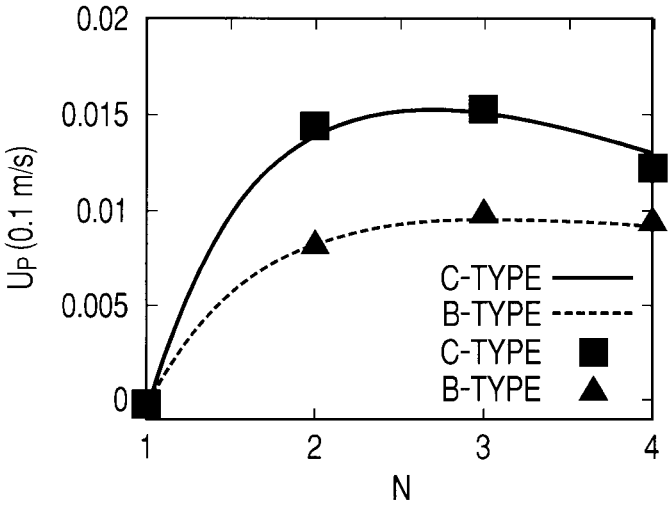

FIGS. 9A and 9B are graphs showing the dependence of the average flow rate Up on the last generation number N. In FIGS. 9A and 9B, results of the calculation according to the above model equations are shown by the solid lines and broken lines, and the numerical solutions according to the Stokes' equation are indicated by characters (black square ■, black triangle ▲, white circle ○, black circle ●).

As understood from the above graphs, the model equations correspond well to the phenomenon. FIG. 9A shows the calculation results for the A-type pump, and FIG. 9B shows the calculation results for the B-type and C-type pumps.

With the above constitution, the interspace between the electrode and the metal post can be made larger, so that the short circuit trouble caused by a conductive dirt contamination in the production process can be prevented.

Figure 4A:
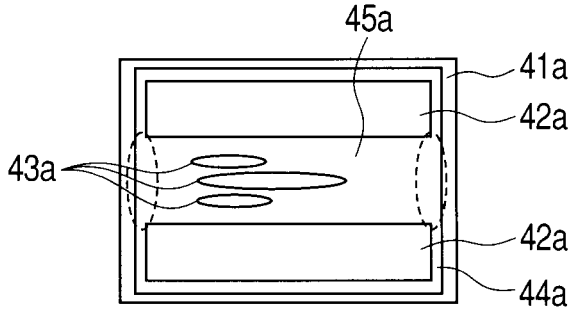
FIGS. 4A and 4B illustrate schematically another constitution of the liquid driver system of the present invention.
Figure 4B:
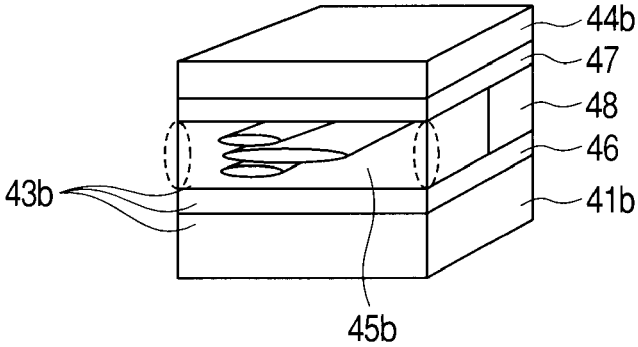
Figure 5A:
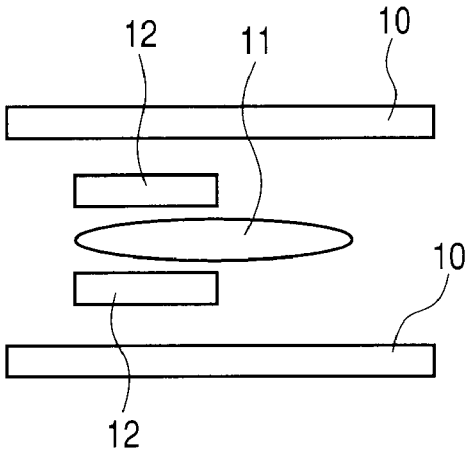
FIGS. 5A, 5B, 5C, and 5D illustrate schematically still another constitution of the liquid driver system of the present invention.
Figure 5C:
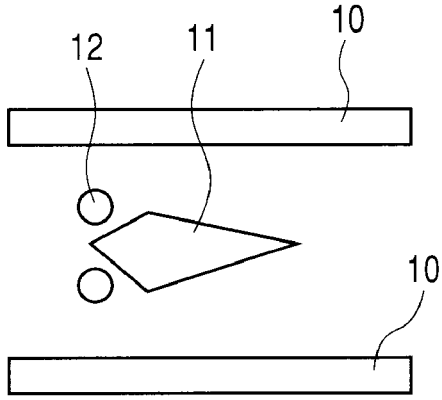
Figure 5B:
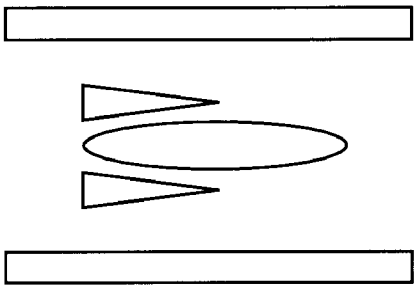
Figure 5D:
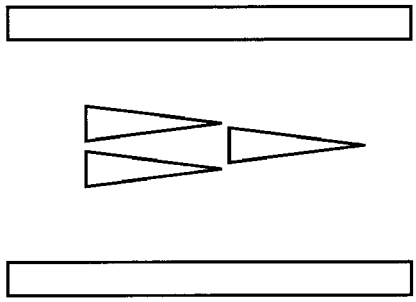
Figure 6A:
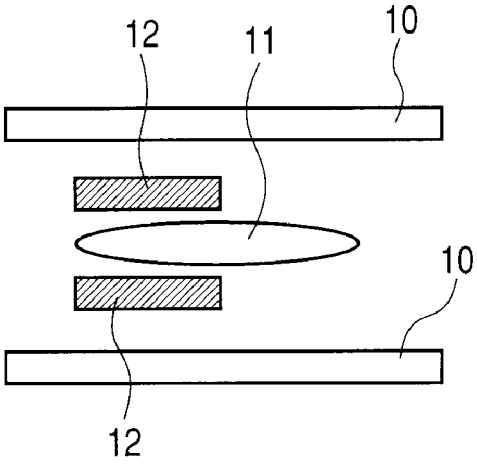
FIGS. 6A, 6B, 6C, and 6D illustrate schematically still another constitution of the liquid driver system of the present invention.
Figure 6C:
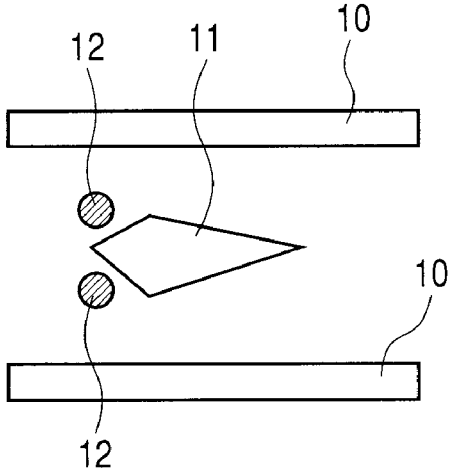
Figure 6B:
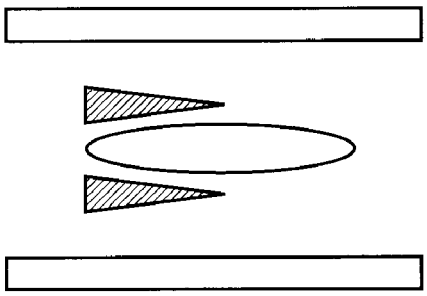
Figure 6D:
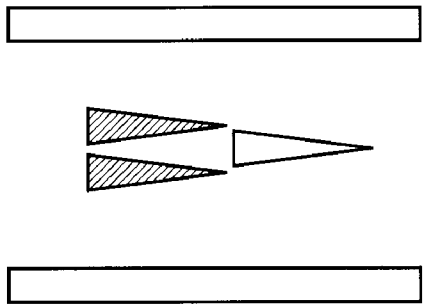
Figure 7A:
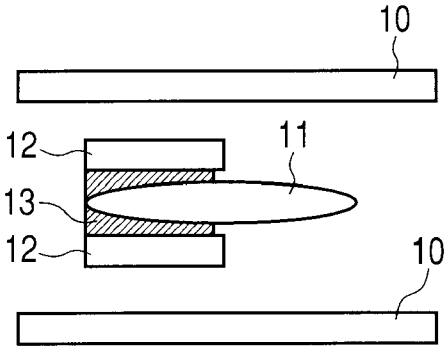
FIGS. 7A, 7B, 7C, and 7D illustrate schematically still another constitution of the liquid driver system of the present invention.
Figure 7C:
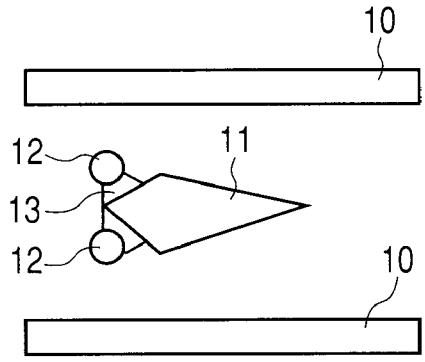
Figure 7B:
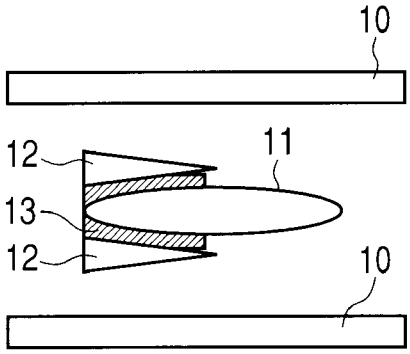
Figure 7D:
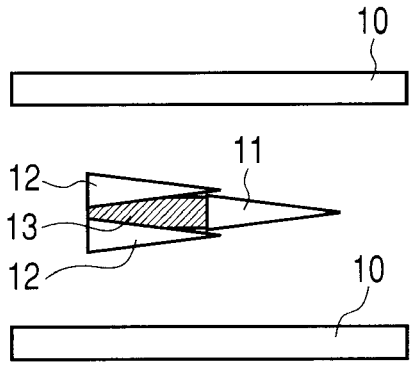

FIGS. 4A and 4B illustrate another constitution of the liquid driver system of the present invention constituted on a base plate.

FIG. 4A illustrates a layer type ICEO pump which is produced by forming, on a base plate 41*a*, simultaneously a pair of electrodes (inactive electrodes) 42*a* (corresponding to parts 1 and 2), inactive conductive columnar electrodes 43*a* (corresponding to parts 11, 12*a*, and 12*b*) composed of a chemically inactive conductive material by a technique of three-dimensional structure formation with a high aspect ratio such as deep-RIE (reactive ion etching) and a GIGA process; and by placing a cover glass thereon to form flow channel 45*a*.

FIG. 4B illustrates a layer type ICEO pump which is produced by counterpoising an insulating base plate 41*b* having inactive thin-film 46 and insulating base plate 44*b* having inactive thin-film electrode 47 with interposition of spacer 48 to form flow channel 45*b*, and placing inactive conductive structures 43*b* (corresponding to parts 11, 12*a*, and 12*b*) in the space of the flow channel. The conductive structures 43*b* (corresponding to parts 11, 12*a*, and 12*b*) in the flow channel space are supported by side walls of the flow channel. The inactive electrodes may be formed from gold, platinum, carbon, or carbon type conductive material.

Comparative Example 1

Figure 10:
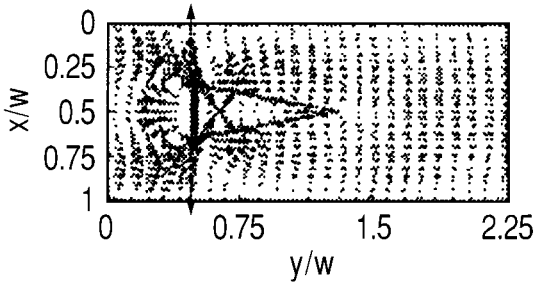
FIG. 10 illustrates a flow of a liquid driven by a conventional liquid driver system.

FIG. 10 shows a flow rate distribution in asymmetric triangular post type of ICEO pump of a prior art technique which has a metal post (conductor member) in a shape of a triangular prism to produce a flow in a normal direction. The conductor member is formed from an electrochemically inactive material.

FIG. 10 shows a result of calculation according to Stokes' equation in consideration of the induced-charge electroosmosis in the same manner as in FIGS. 2A to 2D. In this Comparative Example, the triangle is isosceles, having a base of 0.29w and a height of 0.8w, and is in nearly the same size as the flow limiters and the conductor member shown in FIG. 2B.

As shown in FIG. 10, the asymmetric-triangular-post type pump changes the reverse flow on the conductor member surface to the perpendicular direction only and cannot limit sufficiently the backward flow (producing a reverse flow, a leftward flow).

The average flow rate Up showing the performance of the asymmetric-triangular-post type pump of FIG. 10 is calculated to be 0.11 mm/s. Therefore, the liquid driver system of Example 1 of the present invention has a higher performance.

Example 2

FIGS. 2C and 2D are drawings for describing Example 2 of the present invention. In Example 2, an elliptical columnar metal post having a major axis length of the ellipsoid of 2 (=0.8w) is employed as the k-th generation metal post, and one side thereof is brought near to the interface of electrode 10*a*. On the other side of the metal post, at the region of reverse flow production, another elliptical columnar metal post of a (k+1)-th generation having a length (=b) of half of the elliptical columnar metal post is placed near thereto in layers. The above operation is repeated to N-th generation, being different from Example 1.

This structure decreases the friction near the surface of the electrode.

Example 3

FIGS. 5A to 5D illustrate schematically constitutions of the liquid driver system of Example 3 of the present invention. This Example 3 is the same as Example 1 except that the conductor member and the flow limiter are constituted by combining various polygonal columns 11, 12 such as a quadrangular prism, a triangular prism, a circular column, and elliptical column. This is effective to give more choices in the design for decreasing the flow resistance.

Example 4

FIGS. 6A to 6D illustrate schematically constitutions of the liquid driver system of Example 4 of the present invention. This Example 4 is the same as Example 1 and Example 3 except that the conductor member and the flow limiter are constituted by combining various polygonal columns 11, 12 such as a quadrangular prism, a triangular prism, a circular column, and elliptical column. This is effective to give more choices in the design for decreasing the flow resistance.

Example 5

Figure 8:
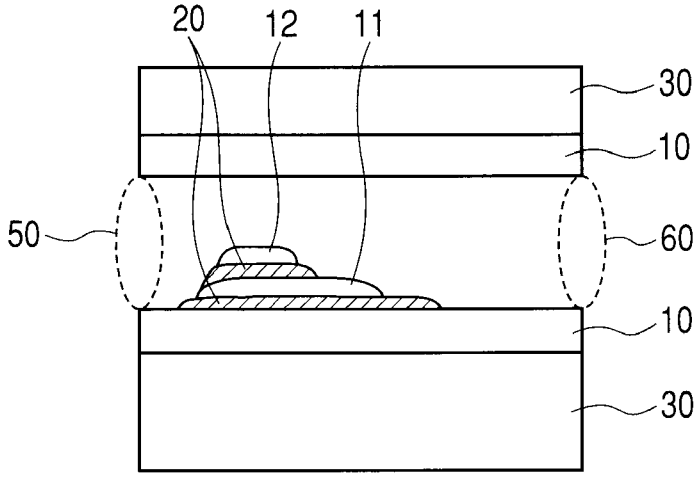
FIG. 8 illustrates schematically still another constitution of the liquid driver system of the present invention.

FIGS. 7A to 7D and FIG. 8 illustrate schematically constitutions of the liquid driver system of Example 5 of the present invention. This Example 5 is the same as Example 1 and Example 3 except that conductive structures 11, 12 serving as the conductor member and the flow limiters are bound with interposition of an insulator 13, 20. This is effective to give more choices in the design for decreasing flow resistance. In FIG. 8, the reference numerals denote the following members: 30, a base plate; 20, an insulator (insulating layer); 50, an inlet of the liquid; and 60, an outlet of the liquid.

INDUSTRIAL APPLICABILITY

The liquid driver system of the present invention is capable of limiting a reverse flow of the liquid caused inevitably regardless of the shape of the conductor member against the normal forward flow, and is applicable in various fields such as chemical fields, medical fields, and electronics fields.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-125787, filed on May 25, 2009 which is hereby incorporated by reference herein in its entirety.

What is claimed is:

1. A liquid driver system having a flow channel for delivering a liquid, comprising:

a conductor member placed in the flow channel;

electrodes for applying an electric field to the conductor member and delivering the liquid by application of a driving force to the liquid by electroosmotic flow produced around the conductor member by the electric field; and a first flow limiter at a position displaced from the conductor member to limit a liquid flow in a reverse direction of liquid flowing in forward and reverse directions relative to the conductor member, wherein a maximum length of the flow limiter is smaller than a length of the conductor member in the forward flow direction, and the flow limiter is placed relative to the conductor member, having a thickness (2*c*), such that a gap (δ) between the conductor member and the flow limiter satisfies the relation of $\delta<c$.

2. The liquid driver system according to claim 1, wherein the conductor member and the first flow limiter are placed with gravity centers thereof displaced from each other.

3. The liquid driver system according to claim 1, wherein a width (w) of the flow channel, a size of the gap (δ) between the conductor member and the first flow limiter, and the thickness (2*c*) of the conductor member satisfy the relation below:

$$(\delta/w)(c/w)<0.03.$$

4. The liquid driver system according to claim 1, further comprising a second flow limiter, with the first and second flow limiters placed on sides of the conductor member.

5. The liquid driver system according to claim 1, wherein a front tip portion of the conductor member facing the liquid flow in the forward flow direction is curved or an acute angle shape.

6. The liquid driver system according to claim 1, further comprising a secondary flow limiter smaller than the first flow limiter and placed near the first flow limiter.

7. The liquid driver system according to claim 1, wherein the first flow limiter is comprised of a conductive material.

8. The liquid driver system according to claim 7, wherein the conductor member and the first flow limiter are placed between the electrodes, and the first flow limiter is displaced such that a gravity center of the first flow limiter is located between a first plane and a third plane or between a second plane and the third plane, wherein the first plane is perpendicular to the flow direction of the flow channel at the top of the conductor member, the second plane is perpendicular to the flow direction of the flow channel at the bottom of the conductor member, and the third plane is perpendicular to the flow direction of the flow channel at a gravity center of the conductor member.

9. A liquid driver system having a flow channel for delivering a liquid, comprising:

a conductor member placed in the flow channel;

electrodes for applying an electric field to the conductor member and delivering the liquid by application of a driving force to the liquid by electroosmotic flow produced around the conductor member by the electric field; and a pair of flow limiters at a position displaced from the conductor member to limit a liquid flow in a reverse direction of liquid flowing in forward and reverse directions relative to the conductive member, wherein the flow limiters are smaller in size than the conductor member and positioned upstream of the conductor member in the forward liquid flowing direction, and a length of the flow limiters is smaller than a length of the conductor member in the forward flow direction.

10. The liquid driver system according to claim 9, wherein the conductor member is placed so that a gravity center is displaced from gravity centers of the flow limiters.

11. The liquid driver system according to claim 9, wherein a front tip portion of the conductor member facing the liquid flow in the forward flow direction is curved or an acute angle shape.

12. The liquid driver system according to claim 9, wherein the flow limiters are comprised of a conductive material.

13. A liquid driver system having a flow channel for delivering a liquid, comprising:

a conductor member placed in the flow channel;

electrodes for applying an electric field to the conductor member and delivering the liquid by application of a driving force to the liquid by electroosmotic flow produced around the conductor member by the electric field; and a pair of flow limiters at a position displaced from the conductor member to limit a liquid flow in a reverse direction of liquid flowing in forward and reverse directions relative to the conductive member, wherein the flow limiters are smaller in size than the conductor member and positioned upstream of the conductor member in the forward liquid flowing direction, wherein a width (w) of the flow channel, a size of a gap (δ) between the conductor member and the flow limiters, and a thickness (2*c*) of the conductor member satisfy the relation below:

$$(\delta/w)(c/w)<0.03.$$

14. The liquid driver system according to claim 13, wherein a length of the flow limiters is smaller than a length of the conductor member in the forward flow direction.

15. The liquid driver system according to claim 13, wherein the conductor member is placed so that a gravity center is displaced from gravity centers of the flow limiters.

16. The liquid driver system according to claim 13, wherein a front tip portion of the conductor member facing the liquid flow in the forward flow direction is curved or an acute angle shape.

17. The liquid driver system according to claim 13, wherein the flow limiters are comprised of a conductive material.

* * * * *